US005220608A

United States Patent [19]

Pfister

[11] Patent Number: 5,220,608

[45] Date of Patent: Jun. 15, 1993

[54] METHOD AND MEANS FOR STEREOPHONIC SOUND REPRODUCTION

[76] Inventor: Arthur Pfister, 17 Wickham Ave., Middletown, N.Y. 10940

[21] Appl. No.: 591,764

[22] Filed: Oct. 2, 1990

[30] Foreign Application Priority Data

Oct. 4, 1989 [DE] Fed. Rep. of Germany ..... 3933170

[51] Int. Cl.[5] ..... H04R 25/00; H04S 5/00

[52] U.S. Cl. ..... 381/17; 381/160; 381/64; 181/155; 181/188; 181/191

[58] Field of Search ..... 181/155, 176, 187, 188, 181/191, 199; 381/160, 1, 17, 64

[56] References Cited

U.S. PATENT DOCUMENTS

| | | | |
|---|---|---|---|
| 2,135,840 | 11/1938 | Pfister | 181/176 |
| 4,225,010 | 9/1980 | Smith | 181/155 |
| 4,348,750 | 9/1982 | Schwind | 381/160 |
| 4,783,814 | 11/1988 | Foley | 381/17 |
| 4,823,908 | 4/1989 | Tanaka et al. | 381/160 |
| 5,004,067 | 4/1991 | Patronis | 181/188 |

*Primary Examiner*—Forester W. Isen
*Attorney, Agent, or Firm*—Brady, O'Boyle & Gates

[57] ABSTRACT

Monophonic sound is transformed into a stereo pattern by arranging two reflectors on a common axis at a predetermined distance from each other with both facing in the direction of the sound. One reflector has a larger diameter than the other and is provided with a central aperture into which a tone generator is mounted and spaced from the smaller reflector.

2 Claims, 1 Drawing Sheet

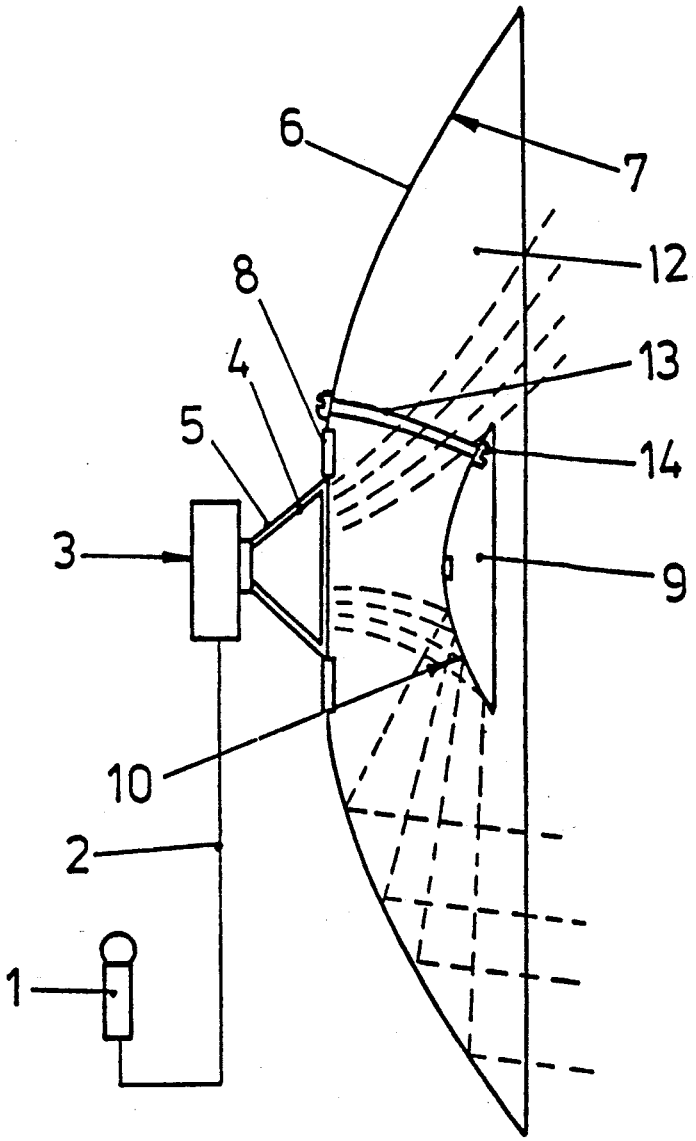
6
7
12
8
4
13
5
14
3
9
10
2
1

METHOD AND MEANS FOR STEREOPHONIC SOUND REPRODUCTION

This invention relates to a method for achieving stereoreproduction in which sound emissions are generated in time and in phase analogous to a mean distance of the human ears from each other and means for implementing this method.

BACKGROUND OF THE INVENTION

Heretofore stereo rendition was only possible by utilizing at the source or point of pickup at least two microphones suitably displaced from each other. Similarly, two loudspeakers were required at point of reception. Interconnecting transmission requires dual audio channels and audio modulated multiplex circuitry for radio transmission.

Meaningful stereo reception tacitly assumes equal hearing sensitivity in both ears of the listener or the addition of loudness controls to accomplish it. Identical sound patterns are emitted by two loudspeaker which are laterally displaced to realize a stereo effect on a listener's ears within an intervening area. The relative position of the loudspeakers to each other and to the listener, as well as the acoustic properties of the surrounding, determine the ultimate stereo quality as perceived by the listener.

SUMMARY OF THE INVENTION

Mindful of these requirements, it is the purpose of this invention to provide the method and the means for transforming into a stereo pattern any monophonic sound or musical rendition at its point of release into a listening area.

By a unique method and means a monophonic sound volume or column of sound, as issued from any tone-generator, electro-acoustic transducer or electrodynamic loudspeaker is split into two equal volumes or halves. One half is allowed to pass by deflectors and controlled hinderance into the listening area while the other half travels a lengthened path with concomitant delay in time, equivalent to the mean distance between the human ears.

Advantageously this method is for application at the receiving end only of any type of monophonic audio signal direct to the tone generator or electro-acoustic transducer. This invention operates solely on the principles of acoustics and optics, devoid of electronics.

In an embodiment of this invention, two reflectors are arranged on a common axis, at a distance from each other, both facing in direction of sound, one reflector of larger diameter being provided with a central round aperture and a tone generator within this aperture and distanced from the smaller reflector.

With these means in place, the expected functions are constructively realized. Based on the difference in diameter between the concentrically arranged reflectors to each other, the desired proportioning of direct to delayed sound is accomplished, aided by the measured distance of the two reflectors to each other. Both reflecting surfaces, facing each other, appropriately reflect the delayed sound portion back and forth, thereby creating the desired delay of proportioned sound. The curvature and distance of the small reflector determines the number of reflections, which may be held to two reflections.

It is therefore an object of this invention to have the two opposing, reflecting surfaces of curved shape where the concave reflecting surface of the outer reflector surrounding the tone generator is advantageously parabolic and the convex reflecting surface of the inner reflector, positioned opposite the tone generator, hyperboloid. Both reflectors may be constructed of suitable metal of high stiffness and be non-resonant. The inner reflector is intended to reflect over the entire concave surface of the outer reflector.

A stipulation is for the diameter of the inner reflector to be larger than the diameter of the tone generator by about $\frac{1}{3}$ to 1/5 or by an average of $\frac{1}{4}$. This will facilitate establishing the said ear to ear distance and also to more readily divide said sound column into two halves.

Statistically, the human ear to ear distance is seven inches. This translates into a reflector gap of mean value of 8.5–9.5 cm, preferably 8:9 cm. At double reflection this would equal the ear to ear distance.

Based on a mean ear to ear distance permits a fixed, permanent attachment of the two reflectors to each other.

Other features and advantages may become apparent in reading the following description of the drawing and the attached claims.

BRIEF DESCRIPTION OF THE DRAWING

The single FIGURE is a side elevational view of the stereo loudspeaker of the present invention.

DESCRIPTION OF THE PREFERRED EMBODIMENT

In the drawing a microphone 1 is connected by line 2 to a tone generator 3 in the form of a loudspeaker. The microphone can be in a sound studio and the tone generator in separated auditorium. It could also be that microphone and tone generator are coupled by wireless or even the tone generator be receiving a program from a disc or tape.

Tone generator 3 could be a dynamic loudspeaker combining high efficiency and wide tone range.

The outer circumference of loudspeaker basket 5 is secured to a central opening within the larger reflector 6 whose concave inner side is finished as a sound reflecting surface 7 of parabolic shape. Basket 5 holds the sound generating voice coil assembly 4, which is standard with the dynamic type of loudspeaker.

Mounting of the loudspeaker basket 5 to reflector 6 is by means of a stiffener ring 8 for a rigid and secure assembly.

Concentric with the large outer reflector 6 is a second reflector 9, smaller and distanced from tone generator 3. Hyperbolically formed it is axially inclined like reflector 6 in the direction of the sound. Its convex surface is facing the concave surface of reflector 6. The convex surface 10 of reflector 9 as well as the concave surface 7 of reflector 6 are highly reflective to sound waves.

The diameter of reflector 9 being less than that of reflector 6, is nevertheless larger than the basket diameter of tone generator 3. The difference amounts to from $\frac{1}{3}$ to 1/5 of the basket diameter. Between the outer reflector 6 and the inner reflector 9 exists a ring area 12, emanating from tone generator 3 and leading directly to the rim of reflector 6.

The distance between first reflector 6 and second reflector 9 is so calculated as to result in a cross-sectional value of 8 cm of ring area. For this description the mean distance is 8.9 cm or 3.5" and accordingly lies between 8.5 and 9.5 cm. This equals one half the distance of the human ears to each other. These distances, also due to their interdependence to other constants, are fixed and rigid.

Permanent distancing of reflector 9 to reflector 6 can be by a single tubular spacer from the apex of reflector 9 to the center of the tone generator 3, or, as in this description by means of three tubular spacers 13 equally spaced about the surface of reflector 9 and reaching to the mounting ring or stiffener 8, common to the tone generator 3 and reflector 6. This leaves the apex of reflector 9 unobstructed.

In the operation, a portion of total sound output emitted by tone generator 3 impinges on the opposite convex surface of the smaller reflector 9 as shown by the dashed lines on the lower half of the illustration. Another portion of total sound emitted by tone generator 3 bypasses reflector 9 and deflects into the circular area 12. This is shown by the dashes in the upper portion of the illustration. The first sound portion intercepted by reflector 9 is about equal in volume to the bypassed or deflected portion. The balance is effected by initial design parameters. From the convex surface 10 of reflector 9, the intercepted sound portion is reflected onto and over the entire concave reflecting surface 7 of reflector 6.

Through interaction of the two from each other distanced reflection surfaces 7 and 10 a double reflection is achieved, translating into a lengthened sound path and concomitant delay for this portion of sound. From here the intercepted sound portion is in turn radiated into circular area 12 and combined with the portion of sound first released. Restoration of the original sound volume takes place in ring area 12 at the mouth of the large reflector 6.

I claim:

1. An arrangement for producing stereophonic-like sound in which in time and/or phase equivalent to the mean distance of the human ears to each other, phase displaced sound emissions are generated, characterized by an electro-acoustic transducer emitting sounds therefrom, a parabolically shaped first reflector surrounding said electro-acoustic transducer, a smaller hyperbolically shaped second reflector mounted in front of and distanced from said electro-acoustic transducer and first reflector, said transducer and reflectors being concentric on one axis and facing in the direction of sound radiation, the axial distance of the smaller reflector from the larger reflector being one-half the distance of the human ears to each other, the diameter of the smaller hyperbolic reflector being larger than the diameter of the electro-acoustic transducer by an amount that allows the total sound output of said electro-acoustic transducer to be divided such that one-half of the total sound output is reflected from the smaller reflector onto and over the entire concave surface of the larger reflector, while the other half of the total sound output is propagated through an annular region between the larger reflector and the smaller reflector directly toward the rim of the larger reflector, whereby the entire sound output of said transducer is split into two halves, wherein one half thereof is propagated directly to the listener's ear, while the other half is delayed equivalent to the distance of the human ears to each other.

2. In an arrangement as set forth in claim 1, wherein the proportional sound volume reflected from the smaller reflector onto the larger reflector is delayed by interactive double reflection with respect to the directly propagated portion of sound, resulting in a stereo pattern of combined sound at the mouth of the large reflector.

* * * * *